US007383665B2

(12) United States Patent
Frobosilo

(10) Patent No.: US 7,383,665 B2
(45) Date of Patent: Jun. 10, 2008

(54) HEADER ARRANGEMENT

(76) Inventor: Raymond C. Frobosilo, 8-01 26th Ave., Astoria, NY (US) 11102

( * ) Notice: Subject to any disclaimer, the term of this patent is extended or adjusted under 35 U.S.C. 154(b) by 0 days.

(21) Appl. No.: 11/509,217

(22) Filed: Aug. 24, 2006

(65) Prior Publication Data

US 2008/0060288 A1 Mar. 13, 2008

(51) Int. Cl.
*E04C 3/02* (2006.01)
*E04C 3/00* (2006.01)
*E04C 3/30* (2006.01)

(52) U.S. Cl. ..... 52/204.2; 52/729.1; 52/579

(58) Field of Classification Search ..... 52/215, 52/729.1, 690, 204.2, 210, 481.2, 579, 80.12, 52/636, 634, 657, 730.6, 481.1, 241
See application file for complete search history.

(56) References Cited

U.S. PATENT DOCUMENTS 559,335 A * 4/1896 Kindl ..... 52/696
1,933,221 A * 10/1933 Rockhoff ..... 52/481.1
3,624,694 A * 11/1971 Byland ..... 52/351
5,117,602 A 6/1992 Marschak
5,553,437 A * 9/1996 Navon ..... 52/729.1
5,930,966 A * 8/1999 Wood et al. ..... 52/364
5,979,136 A * 11/1999 Marschak ..... 52/588.1
7,021,021 B2 * 4/2006 Saldana ..... 52/696
7,216,465 B2 * 5/2007 Saldana ..... 52/655.1
2006/0096192 A1 * 5/2006 Daudet ..... 52/204.1

* cited by examiner

*Primary Examiner*—Robert Canfield
*Assistant Examiner*—Ryan D Kwiecinski
(74) *Attorney, Agent, or Firm*—Notaro & Michalos P.C.

(57) ABSTRACT

A header arrangement has an elongated, lower, and substantially horizontal flange with a downwardly open U-shape for embracing a wall structured along at least part of the length of the lower flange, an elongated, and substantially vertical web connected along and extending upwardly from the lower flange, and an elongated, upper, and substantially horizontal flange connected along an upper edge of the vertical web and also having a U-shape. Web stiffeners and end stiffeners are engaged to the flanges and web to brace the header arrangement against static and dynamic loads.

17 Claims, 5 Drawing Sheets

FIG. 7
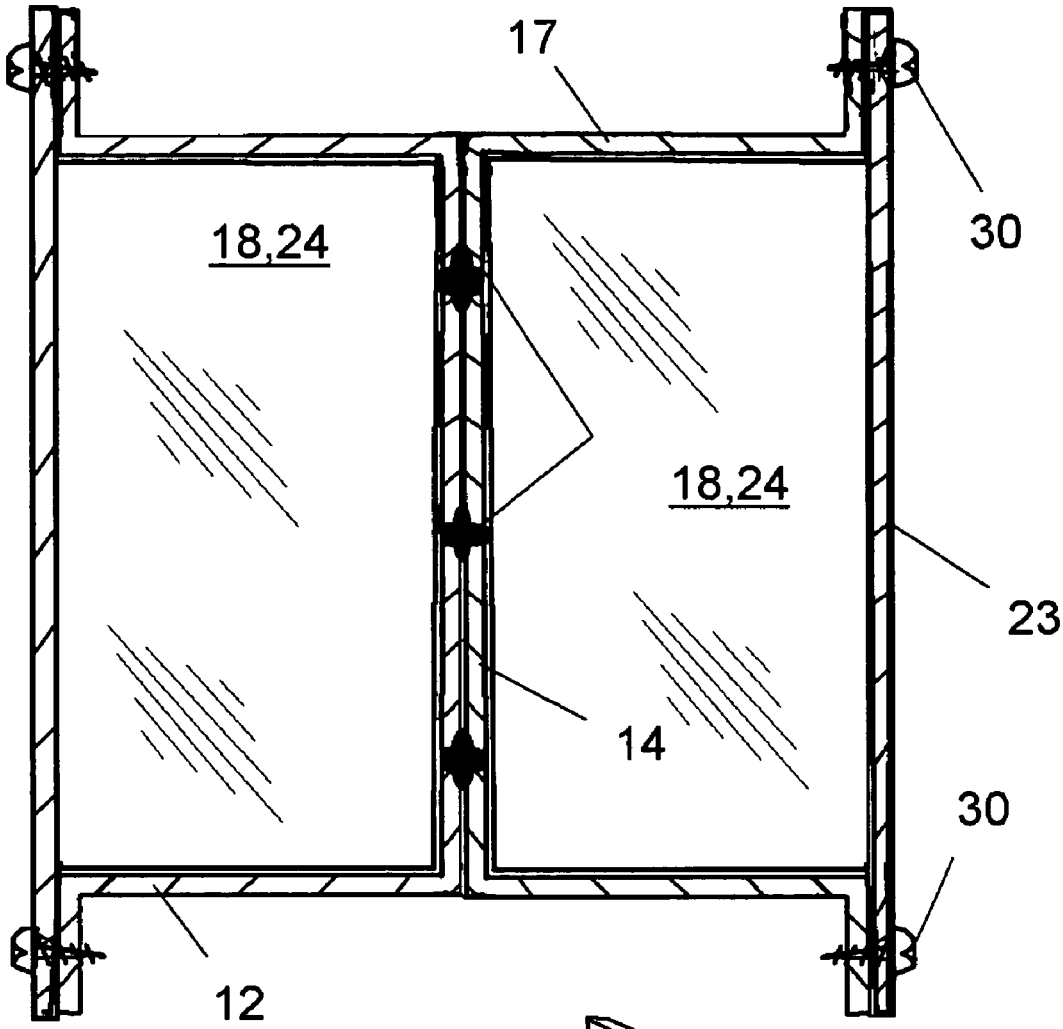
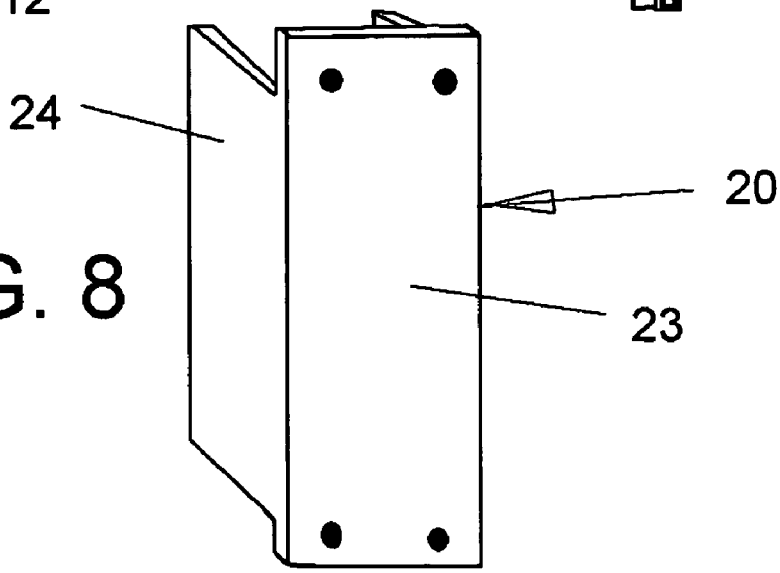
FIG. 8

HEADER ARRANGEMENT

FIELD AND BACKGROUND OF THE INVENTION

The present invention relates in general to the field of building components and construction, and in particular to a new and useful header arrangement for use in metal and non-metal buildings.

U.S. patent application Ser. No. 10/801,068 filed Mar. 15, 2004 is incorporated here by reference, and discloses the inventor's previous invention of a Metal Building Construction. This prior patent application, among other times, discloses metal building panels that advantageously interlock at Z-shaped structures provided at the opposite vertical edges of each panel.

Virtually all buildings include openings through their walls in the form of windows, doors and other needed openings of various heights and widths. Since these openings necessarily weaken the static or vertical load bearing capacity of the wall, at least in the area of the opening, measures must be taken to increase the strength of the wall above each opening. The aforementioned U.S. patent application Ser. No. 10/801,068, solves this problem by connecting shorter metal panels that are of similar construction to the longer wall panels, in a side-by-side arrangement to span each opening. For windows, a similar combination of shorter panels is also provided below each window.

In more conventional wooden stud wall and other building constructions, this problem is solved using headers in the form of strong, wide and heavy wooden beams that span the top of each opening and provide the needed load support.

U.S. Pat. No. 5,117,602 for a Structural Panel for Prefabricated Buildings, discloses a structural member having an elongated panels with generally Z-shaped portions that nest with each other. Flanges of the nested panels cooperate to form a receptacle for a stud or joist to form a wall, floor or ceiling combination, and U.S. Pat. No. 5,979,136 for a Prefabricated Structure Panel discloses a structural member having elongated panels with Z-shaped, nested portions and reinforcing members at the top and bottom of plural nested panels, along with top and bottom plates.

A need remains for a header arrangement that is light in weight and strong in construction, and particularly although not exclusively, suited for metal building construction.

SUMMARY OF THE INVENTION

It is an object of the present invention to provide a header made of sheet metal that is light yet strong in the vertical direction for supporting static or vertical load, e.g. the load of the roof or floors of a building above the header, and which is strong in the horizontal direction to resist dynamic or horizontal load, e.g. wind load, as well as resisting twisting loads.

Accordingly, a further object of the invention is to provide a header arrangement comprising: an elongated, lower, and substantially horizontal flange having a downwardly open U-shape for embracing a wall structured along at least part of the length of the lower flange; an elongated, substantially vertical web connected along and extending upwardly from the lower flange; and an elongated, upper, and substantially horizontal flange connected along an upper edge of the vertical web and also having a U-shape.

According to another object of the invention, the header arrangement has lower and upper flanges and a vertical web formed of a pair of mirror members which each have part of each flange and a vertical web panel, the vertical web panels being coextensive with respect to each other and being connected to each other to form the vertical web.

The lower and upper flanges and the vertical web are preferably made of sheet metal and the U-shape of the upper flange is preferably downwardly open.

The lower and upper flanges and the vertical web together form a polygonal pocket on at least one side of the vertical web, and the arrangement may include one or preferably multiple web stiffeners connected to at least one of the flanges and extending into the pocket for bracing the flanges and the vertical web.

Another object of the invention is to provide the header arrangement with additional metal components to facilitating assembly of the header arrangement into the remainder of a metal building construction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 7 is a view similar to FIG. 6 of another embodiment of the invention;

FIG. 8 is a front perspective view of a web stiffener of the embodiment of FIG. 7.

DESCRIPTION OF THE PREFERRED EMBODIMENTS

Figure 1:
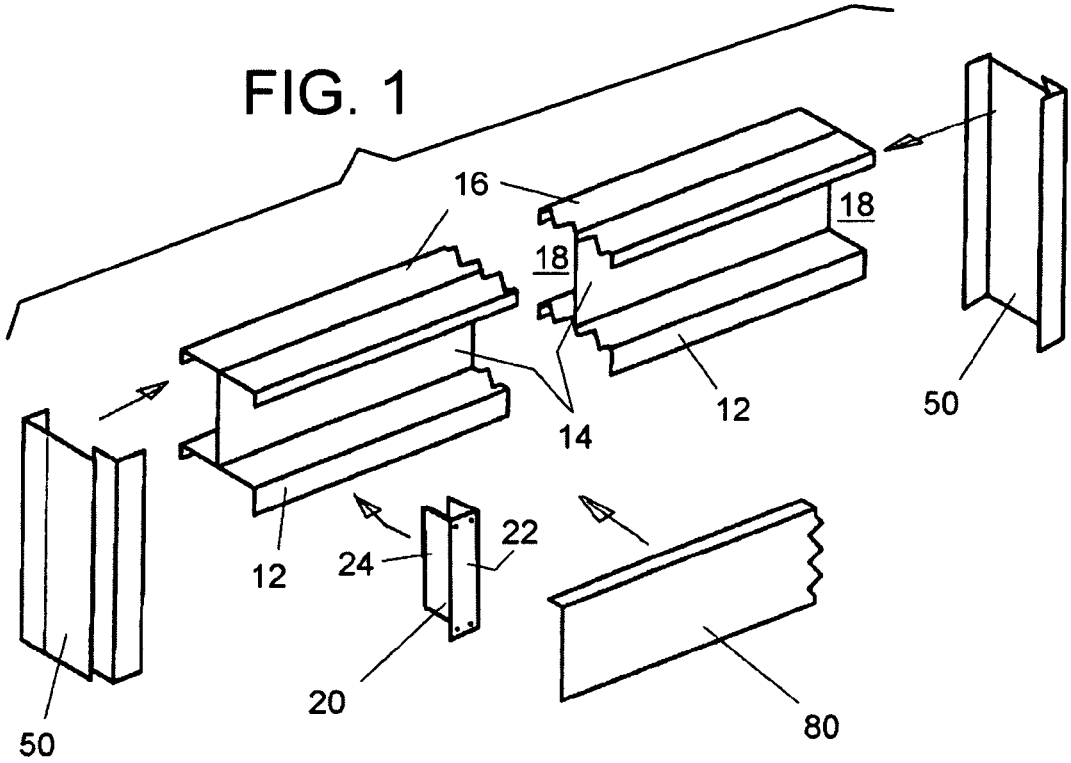
FIG. 1 is an exploded perspective view of parts of a header arrangement according to the present invention.
Figure 2:
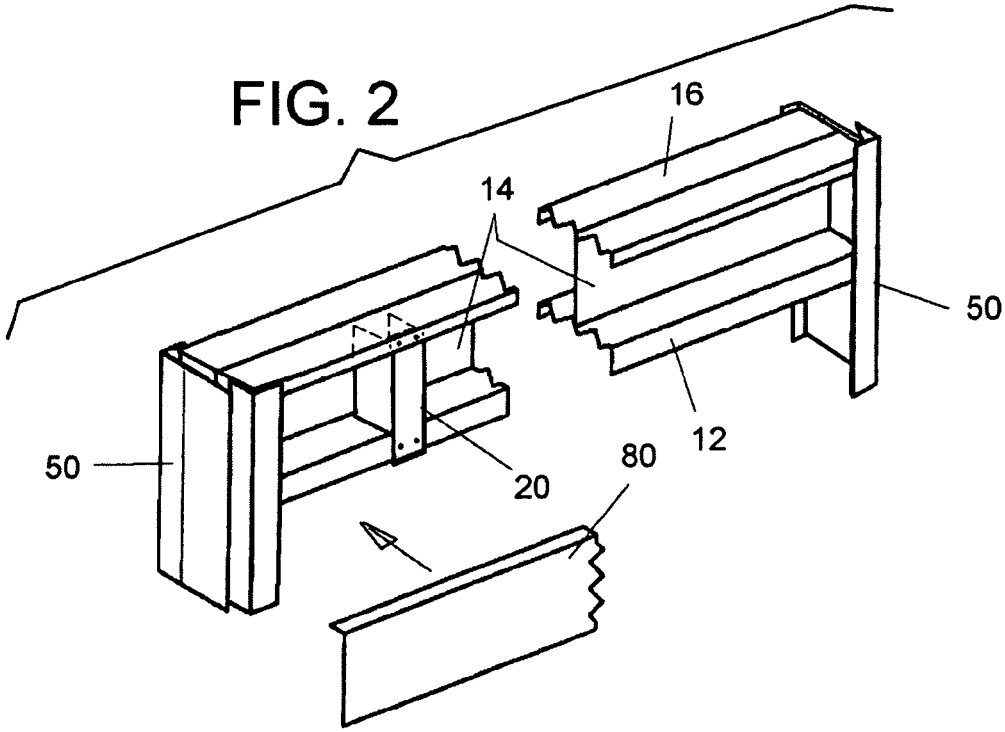
FIG. 2 is a view similar to FIG. 1 but with some of the parts assembled.

Referring now to the drawings, in which like reference numerals are used to refer to the same or similar elements, FIGS. 1 to 6 show a header arrangement comprising an elongated, lower, and substantially horizontal flange 12 having a downwardly open U-shape for embracing a wall structure along at least part of the length of the lower flange, for example, on opposite sides of an opening in the wall to be spanned by the header arrangement. An example of such a wall structure is the pair of wall panels 42 and 44 shown in FIG. 3 and similar to the wall panels disclosed in the incorporated U.S. patent application Ser. No. 10/801,068.

The header arrangement also includes an elongated, substantially vertical web 14 connected along and extending upwardly from the lower flange 12. An elongated, upper, and substantially horizontal flange 16 is connected along an upper edge of the vertical web 14 and has a U-shape as well. The lower and upper flanges 12, 16, each having outer elongated edges with a downwardly extending flange plates

Figure 6:
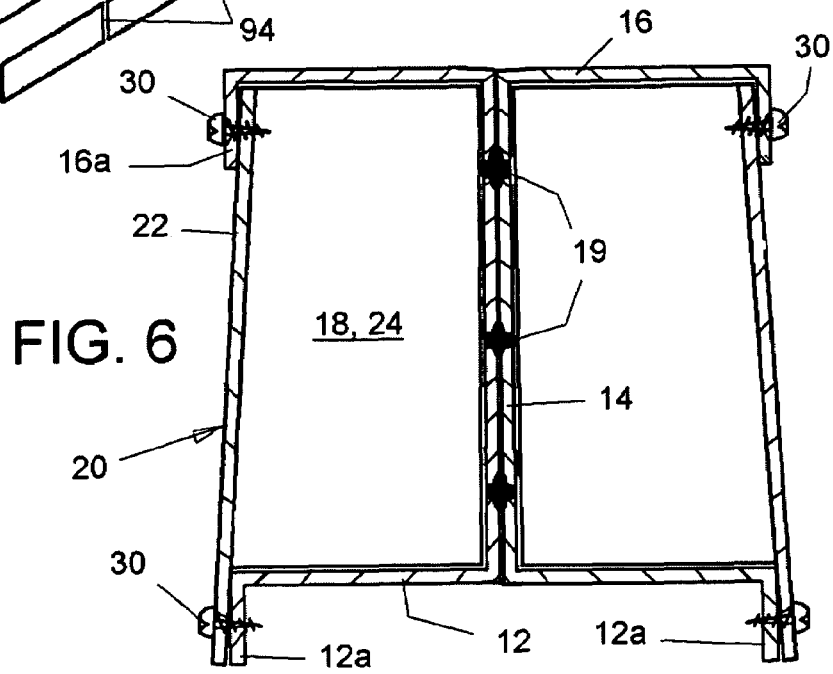
FIG. 6 is a vertical sectional view of the header arrangement of the invention, taken along line 6-6 of FIG. 3.

12*a* and 16*a* best shown in FIG. 6, forming at least part of each U-shape. The flanges and the vertical web together form a pair of polygonal, e.g. substantially rectangular pockets 18 on opposite sides of the vertical web 14.

The lower and upper flanges 12, 16, and the vertical web 14 are formed of a pair of mirror image members which each have part of each flange and a vertical web panel that are back-to-back and spot welded or otherwise fastened to each other as shown in FIG. 6 at 19, the vertical web panels being coextensive with respect to each other and being connected to each other to form the vertical web 14.

The arrangement includes a plurality of web stiffeners 20 each connected to at least one of the flange plates 12*a* and/or 16*a*, but preferably to both, and each extending into at least one of the pockets for bracing the flanges and the vertical web. Each stiffener comprising an outer plate 22 that is vertically long enough to span the distance between the flange plates 12*a* and 16*a* of the upper and lower flanges 12 and 16 as best shown in FIG. 6, the flange plates of both of the upper and lower flanges being connected, e.g. by screws of other fasteners 30 to the outer plate 22. Each stiffener further comprising a pocket plate 24 connected to each vertical edge of the outer plate and being shaped and sized to extend into one of the pockets, in close proximity to, or in contact with inner surfaces of the flanges and the vertical web in the pocket. Each web stiffener is thus also U-shaped in top plan view, and the vertical length of the outer plate 22 is greater, at least downwardly of the pocket plate so that there is enough extension of the outer plate 22 to overlap the lower flange plate 12*a* and be connected thereto by screws 30.

As shown in FIG. 6, the upper end of the outer web plate 22 extends along the inside surface of the flange plate 16*a* of the upper flange 16, and is also connected to this upper flange plate by screws 30 to positively secure both ends of the web stiffener to the header beam formed of the flanges 12, 16 and web 14.

Stiffeners are spaced along the header arrangement, e.g. every 2 feet or as needed depending on the static and dynamic loads contemplated for the building, and may be staggered or aligned with respect to each other on opposite side of the vertical web 14.

Figure 3:
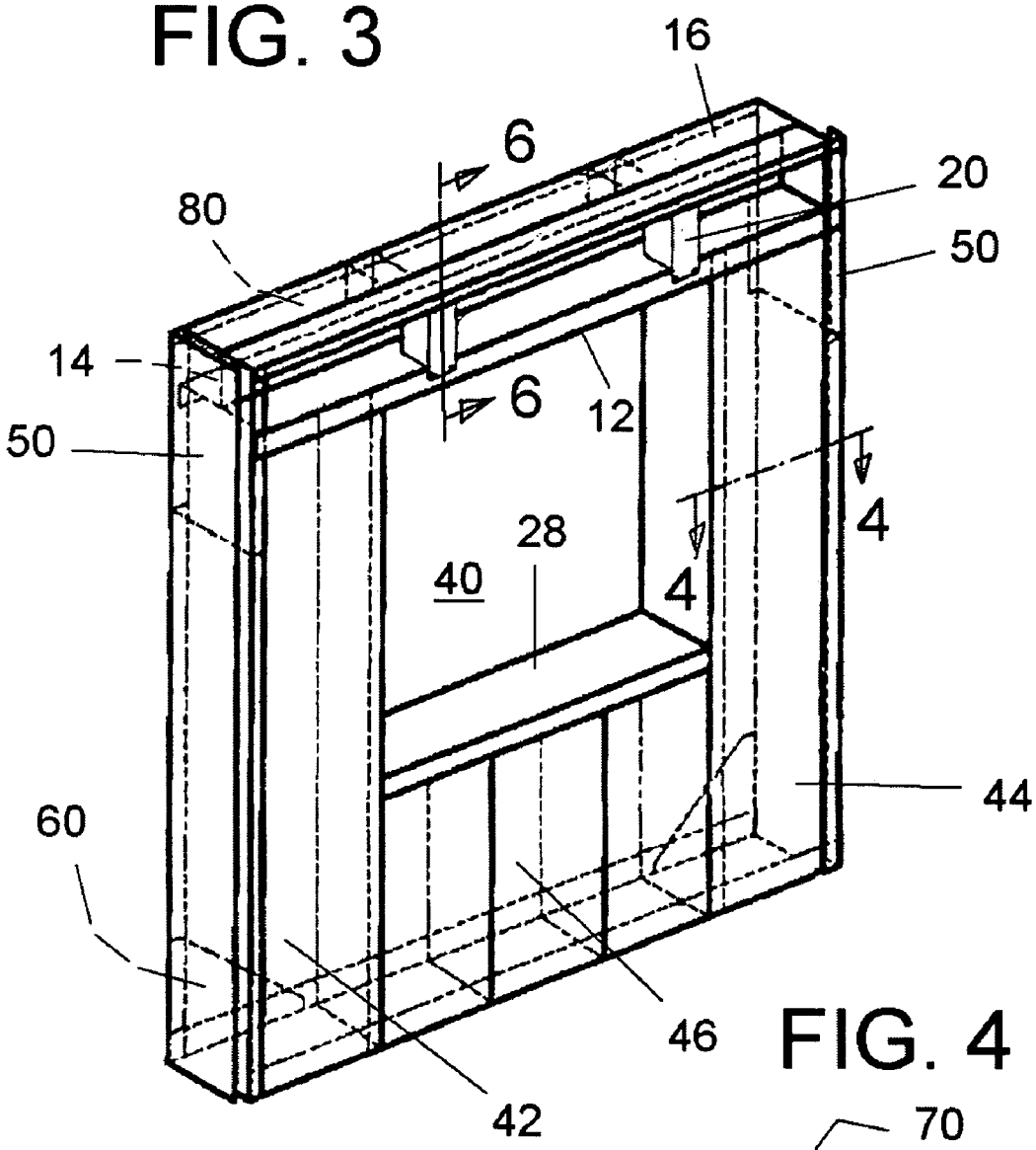
FIG. 3 is a perspective view of a section of wall of a metal building construction including the header arrangement of the present invention.

The header arrangement of the invention is adapted to extend over any opening in the wall of a building, such as a door or, as shown in FIG. 3 for example, a window 40 formed between tall wall panels or panel assemblies 42 and 44, and a short lower wall panel or panel assembly 46 under the window opening 40. The header assembly in this case comprises a header beam made up of the flanges 12, 16 and web 14 with one or more web stiffeners 20 as needed to stiffen the beam, the beam extending over the top of the window 40 and along the tops of the adjacent panels 42 and 44, for at least some distance.

In the case of the wall in FIG. 3 being, for example, an 8 foot wall section to be assembled into a final wall of greater size, the header beam may also advantageously be 8 feet long and therefore span the entire wall section width. The window or door opening 40 may be any width that is sufficiently less than 8 feet so that at least some part of the header beam extends over the opposite wall panels, e.g. by at least 6 inches.

The beam thus extends over part or all of each of the wall panels 42 and 44, and the panels are each closely embraced over their top ends by the downwardly U-shaped lower flange 12. The lower border of window 40 formed by the top ends of the short panel or panel assembly 46, is also covered and closely embraced by a downwardly U-shaped sill track 28 for engagement over the lower wall forming the lower end of the window. Sill track 28 is fastened in place by screws or other suitable fasteners.

To further integrate the header beam into the wall, and especially to resist any side loads on the header such as those caused by wind or any unevenness in the vertical load that may tend to twist the header beam out of its required vertical orientation, the arrangement includes at least one, but preferably two opposite and substantially U-shaped end stiffeners 50 connected to each opposite end of the header beam as shown in FIG. 3, and shaped to cover an end of the pair of pockets 18 on each side of web 14.

Figure 9:
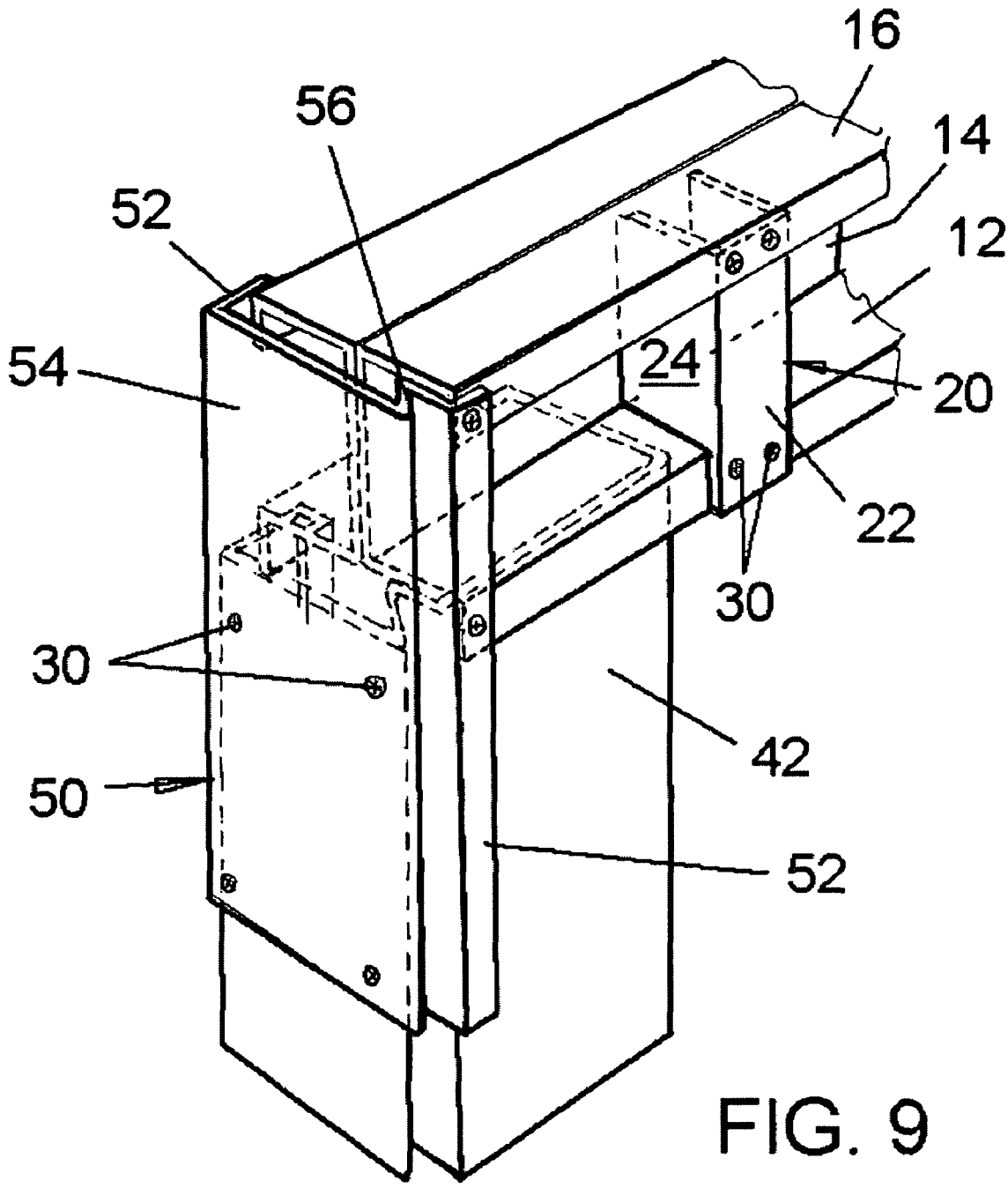
FIG. 9 is a partial, perspective view of a key assembly of the header arrangement of the present invention.

Referring to FIG. 9, the end stiffeners 50 each having a pair of spaced apart vertical rails 52 and a wall plate 54 connected between the vertical rails. The wall plate 54 includes a Z-shaped portion 56 such as those disclosed in U.S. patent application Ser. No. 10/801,068. Each end stiffener 50 is vertically long enough to fully cover the end of the header beam and also to extend downwardly over (as shown) or under (i.e. inside wall panel 42 as not shown but as still possible), the wall panel that is itself under that end of the beam, e.g. panel 42 in FIG. 9. Each panel 42, 44 and even lower wall panels 46, are U-shaped and have one or two Z-shaped portions at one or both end of each wall panel. In this way the Z-shaped portions of the wall panels, at least at one end of the header beam, engages the Z-shaped portion 56 of the end stiffener 50. Screws 30 or other fasteners are used to fix the end stiffeners to the header beam and wall panels. The end stiffener 50 can thus be outside or inside the panel 42 it extends to, to help prevent twisting of the header beam. Although shown with the Z-shaped portion 56, stiffener 50 can be a simple U-shape with a flat or other shaped wall plate 54, to engage differently shaped wall panels, wall studs or other wall members that can be used with the header arrangement of the present invention.

The end stiffeners 50, which are advantageously 1 to 3 feet long (preferably about 2 feet long) and wide enough to embrace the end of the header beam, and, in conjunction with the web stiffeners for the header beams of over about 2 feet long, have been found by actual testing to be extremely strong against both vertical and transverse or side loads, and are well suited for building construction since they exceed all code requirements.

The same end stiffener 50 is used at both ends of the header beam as shown in FIG. 1, with the vertical position of one simply being inverted with respect to the other.

To further strengthen the wall as shown in FIG. 3, the outer wall panels each having a lower end and the arrangement includes a triangular gusset plate 60 connected to the lower end of the wall panel for reenforcement.

Figure 4:
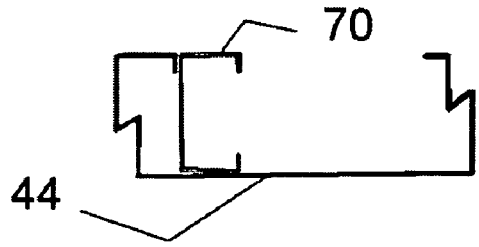
FIG. 4 is a sectional view taken along line 4-4 of FIG. 3.
Figure 5:
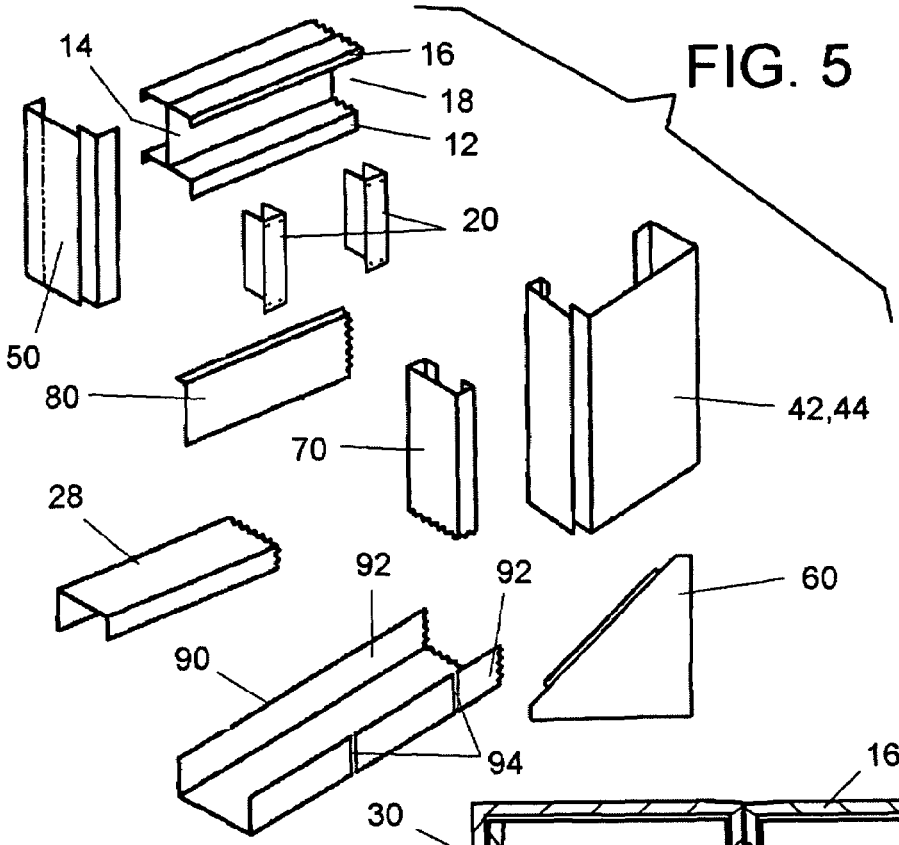
FIG. 5 is an exploded view of component parts of the header arrangement of the present invention.

One or both vertical side borders of the window 40 are also reenforced by vertical, U-shaped jack studs 70 that are fastened, e.g. by screws, to the side portions of the wall panels 42 or 44 that form that border of the window as shown, for example, in FIG. 4.

An L-shaped cover plate 80 is also fastened, e.g. by screws, over one or both sides of the header beam to close the outer, otherwise open pocket at one or both sides of the header beam.

An upwardly open, U-shaped floor track 90 is also provided at the bottom of the wall (see FIGS. 3 and 5) and has side plates 92 with spaced slots 94 in at least one of the inside or outside plate for drainage in case water is trapped or condenses inside the wall.

FIGS. 7 and 8 illustrate an embodiment of the invention that uses an upwardly U-shaped upper flange 17 and modified web stiffener 20 with outer plate 23 having upper and lower extensions that go beyond the pocket plates 24 so that they can be fastened, e.g. by screws 30, to the flange plates of the upper and lower flanges. This embodiment allows both the upper and lower flanges to embrace walls extending along the header beam.

All parts of the header arrangement of the invention are preferably made of galvanized or otherwise corrosion resistant sheet metal of appropriate gauge, e.g. 24 to 16 gauge, preferably 22 to 18 gauge and still more preferably 22 or 20 or 18 gauge steel, as needed for a particular building. Each piece can be cut to shape and bent into the form called for by this disclosure.

Although the header arrangement of the present invention is best suited to metal building construction using panels, it can equally be used for conventional metal or even wood stud construction.

While specific embodiments of the invention have been shown and described in detail to illustrate the application of the principles of the invention, it will be understood that the invention may be embodied otherwise without departing from such principles.

What is claimed is:

1. A header arrangement comprising: an elongated, lower, substantially horizontal flange having a U-shape and for engaging a wall structure along at least part of a length of the lower flange; an elongated, substantially vertical web connected along and extending upwardly from the lower flange; and an elongated, upper, substantially horizontal flange connected along an upper edge of the vertical web and having a U-shape; the lower and upper flanges and the vertical web together forming a header beam and together creating a pair of polygonal pockets on opposite sides of the vertical web, the arrangement including at least one substantially U-shaped end stiffener connected to one end of the header beam and shaped to cover an end of the pair of pockets, the end stiffener having a pair of spaced apart vertical rails, and a wall plate connected between the vertical rails, the wall plate including a Z-shaped portion adapted to engage a similar Z-shaped portion of a wall panel under the header arrangement.

2. The header arrangement of claim 1, wherein the lower and upper flanges and the vertical web are formed of a pair of mirror members which each have part of each flange and a vertical web panel, the vertical web panels being coextensive with respect to each other and being connected to each other to form the vertical web.

3. The header arrangement of claim 1, wherein the lower and upper flanges and the vertical web are made of sheet metal and the U-shape of the upper and lower flanges are both downwardly open.

4. The header arrangement of claim 1, wherein the lower and upper flanges and the vertical web are made of sheet metal and are formed of a pair of mirror members which each have part of each flange and a vertical web panel, the vertical web panels being coextensive with respect to each other and being connected to each other to form the vertical web, the U-shape of the lower and upper flanges both being downwardly open.

5. The header arrangement of claim 1, including at least one web stiffener connected to at least one of the flanges and extending into one of the pockets for bracing the flanges and the vertical web.

6. The header arrangement of claim 1, including a plurality of web stiffeners each connected to at least one of the flanges and each extending into at least one of the pockets for bracing the flanges and the vertical web.

7. The header arrangement of claim 1, including a plurality of web stiffeners each connected to at least one of the flanges and each extending into at least one of the pockets for bracing the flanges and the vertical web, the lower and upper flanges and the vertical web being made of sheet metal and being formed of a pair of mirror members which each have part of each flange and a vertical web panel, the vertical web panels being coextensive with respect to each other and being connected to each other to form the vertical web, the U-shape of the upper and lower flanges being downwardly open.

8. The header arrangement of claim 1, wherein the lower and upper flanges each have outer elongated edges with a downwardly extending flange plate forming at least part of each U-shape, the arrangement including a plurality of web stiffeners each connected to at least one of the flanges and each extending into at least one of the pockets for bracing the flanges and the vertical web, each stiffener comprising an outer plate that is vertically long enough to span the distance between the flange plates of the upper and lower flanges, the flange plates of both of the upper and lower flanges being connected to the outer plate, each stiffener further comprising a pocket plate connected to each opposite vertical edge of the outer plate and being shaped and sized to extend into one of the pockets, in close proximity to, or in contact with surfaces of the flanges and of the vertical web in the pocket.

9. The header arrangement of claim 1, wherein the lower and upper flanges each have outer elongated edges with a downwardly extending flange plates plate forming at least part of each U-shape, the arrangement including a plurality of web stiffeners each connected to at least one of the flanges and each extending into at least one of the pockets for bracing the flanges and the vertical web, each stiffener comprising an outer plate that is vertically long enough to span the distance between the flange plates of the upper and lower flanges, the flange plate of at least one of the upper and lower flanges being connected to the outer plate, the stiffener further comprising a pocket plate connected to each vertical edge of the outer plate and being shaped and sized to extend into one of the pockets, in close proximity to, or in contact with surfaces of the flanges and the vertical web in the pocket.

10. The header arrangement of claim 1, the U-shape of the upper flange being upwardly open and the U-shape of the lower flange being downwardly open.

11. The header arrangement of claim 1, the U-shape of the upper flange being formed by a pair of upwardly extending flange plates and being upwardly open and the arrangement including at least one web stiffener connected to at least one of the flange plates and extending into the pocket for bracing the flanges and the vertical web, the U-shape of the lower flange being downwardly open.

12. The header arrangement of claim 1, the U-shape of the upper flange being upwardly open and the arrangement including at least one web stiffener connected to at least one of the flanges and extending into the pocket for bracing the flanges and the vertical web, the stiffener comprising an outer plate that is vertically long enough to span the distance between the flange plates of the upper and lower flanges, the flange plates of both of the upper and lower flanges being connected to the outer plate, each stiffener further comprising a pocket plate connected to each vertical edge of the outer plate and being shaped and sized to extend into one of the pockets, in close proximity to, or in contact with surfaces of the flanges and the vertical web in the pocket, the U-shape of the lower flange being downwardly open.

13. The header arrangement of claim 1, including an L-shaped cover plate connected to at least one of the upper and lower flanges for covering at least part of one of the pockets.

14. A header arrangement comprising: an elongated, lower, substantially horizontal flange having a U-shape and for engaging a wall structure along at least part of a length of the lower flange; an elongated substantially vertical web connected along and extending upwardly from the lower flange; and an elongated, upper, substantially horizontal flange connected along an upper edge of the vertical web and having a U-shape; and wherein the lower and upper flanges and the vertical web together form a header beam and together create a pair of polygonal pockets on opposite sides of the vertical web, the arrangement including at least one substantially U-shaped end stiffener connected to one end the header beam and shaped to cover an end of the pair of pockets, the end stiffener having a pair of spaced apart vertical rails and a wall plate connected between the vertical rails, the wall plate including a Z-shaped portion, the arrangement further including a wall panel under the header arrangement with a similar Z-shaped portion for engaging the Z-shaped portion of the end stiffener, the end stiffener being long enough to extend the entire vertical height of the header beam and to extend over at least some of a side of the wall panel for bracing the header beam against side load and twisting.

15. A header arrangement comprising: an elongated lower, substantially horizontal flange having a U-shape and for engaging a wall structure along at least part of a length of the lower flange; an elongated substantially vertical web connected along and extending upwardly from the lower flange; and an elongated, upper, substantially horizontal flange connected along an upper edge of the vertical web and having a U-shape; and wherein the lower and upper flanges and the vertical web together form a header beam and together create a pair of polygonal pockets on opposite sides of the vertical web, the arrangement including at least one substantially U-shaped end stiffener connected to one end the header beam and shaped to cover an end of the pair of pockets, the end stiffener having a pair of spaced apart vertical rails and a wall plate connected between the vertical rails, the wall plate including a Z-shaped portion, the arrangement further including a U-shaped wall panel under the header arrangement with a Z-shaped portion for engaging the Z-shaped portion of the end stiffener, the wall panel having a lower end and the arrangement including a gusset plate connected to the lower end of the wall panel for reenforcing the wall panel.

16. A header arrangement comprising: an elongated, lower, and substantially horizontal flange having a downwardly open U-shape for embracing a wall structure along at least part of the length of the lower flange; an elongated, substantially vertical web connected along and extending upwardly from the lower flange; and an elongated, upper, and substantially horizontal flange connected along an upper edge of the vertical web and having a U-shape, the lower and upper flanges each having outer elongated edges with a downwardly extending flange plate forming at least part of each U-shape, the flanges and the vertical web together forming a pair of polygonal pockets on opposite sides of the vertical web, the arrangement including a plurality of web stiffeners each connected to at least one of the flanges and each extending into at least one of the pockets for bracing the flanges and the vertical web, each stiffener comprising an outer plate that is vertically long enough to span the distance between the flange plates of the upper and lower flanges, the flange plates of both of the upper and lower flanges being connected to the outer plate, each stiffener further comprising a pocket plate connected to each vertical edge of the outer plate and being shaped and sized to extend into one of the pockets, in close proximity to, or in contact with surfaces of the flanges and the vertical web in the pocket; and wherein the lower and upper flanges and the vertical web together form a header beam, the arrangement including at least one substantially U-shaped end stiffener connected to one end the header beam and shaped to cover an end of the pair of pockets the end stiffener having a pair of spaced apart vertical rails and a wall plate connected between the vertical rails the wall plate including a Z-shaped portion, the arrangement further including a U-shaped wall panel under the header arrangement and extending along one side of a window, the wall panel having a Z-shaped portion for engaging the Z-shaped portion of the end stiffener, the wall panel having a lower end and the arrangement including a gusset plate connected to the lower end of the wall panel for reenforcing the wall panel.

17. The header arrangement of claim 16, wherein the arrangement is adapted to extend over a window, the arrangement including a downwardly U-shaped sill track for engagement over a lower wall portion forming a lower end of the window.

* * * * *